United States Patent [19]

Johnson

[11] 4,295,791

[45] Oct. 20, 1981

[54] SCALLOPED CERAMIC TURBINE

[75] Inventor: Jesse F. Johnson, St. Clair Shores, Mich.

[73] Assignee: General Motors Corporation, Detroit, Mich.

[21] Appl. No.: 67,797

[22] Filed: Aug. 20, 1979

[51] Int. Cl.[3] ..... F01D 5/14; F01D 5/28

[52] U.S. Cl. ..... 416/241 B

[58] Field of Search ..... 416/241 B, 244 A, 244 R

[56] References Cited

U.S. PATENT DOCUMENTS

| | | | |
|---|---|---|---|
| 2,888,239 | 5/1959 | Slemmons | 416/241 B |
| 2,922,619 | 1/1960 | Slemmons | 416/244 R |
| 3,121,555 | 2/1964 | Aspinwall | 416/244 R |
| 3,255,994 | 6/1966 | Dreimanis | 416/244 A |
| 3,262,676 | 7/1966 | Huebner, Jr. et al. | 416/244 A |
| 3,897,171 | 7/1975 | Stahl | 416/241 B |

*Primary Examiner*—William L. Freeh

*Attorney, Agent, or Firm*—J. C. Evans

[57] ABSTRACT

A unitary ceramic gas turbine wheel for use in gas turbine engines having turbine inlet temperatures in excess of 2000° F. includes an outer rim of reduced axial length that is merged with scallops in the upstream face of the turbine wheel to reduce leading edge stresses in integral turbine wheel blades of airfoil configuration and wherein the fairing of the airfoil into the rim is configured to produce a reduction in the polar moment of inertia of the turbine wheel to improve engine acceleration characteristics.

1 Claim, 5 Drawing Figures

SCALLOPED CERAMIC TURBINE

This invention relates to gas turbine engines and more particularly to high temperature turbine wheel components for use in gas turbine engine applications.

In gas turbine engine technology it is recognized that both performance and gas turbine engine fuel economy can be improved by increasing the power turbine inlet temperature level. Accordingly, it is desirable to include components of ceramic composition in the gas turbine engine such as for turbine wheels that are driven by combustion products discharged from the burner of the gas turbine engine.

An object of the present invention is to provide an improved high temperature resistant unitary gas turbine wheel which is especially suited for fabrication from ceramic compositions and including integral portions thereon configured to reduce stress concentrations in the leading edges of airfoil configured turbine blades formed integrally on the ceramic wheel at circumferentially separate points thereon and extending radially outwardly of an integral rim of the wheel.

Still another object of the present invention is to provide an improved ceramic turbine wheel having an integrally formed rim having a gas flow surface thereon which is of reduced length and located in a downstream relationship to the leading edges on integral radially extending, circumferentially spaced airfoil configured blades on the wheel, each blade having its leading edge faired into the rim to form a plurality of inertia reducing scallops across the upstream face of the turbine wheel and configured to reduce leading edge stresses resulting from differential axial thermal growth between the roots of individual airfoil configured integral blade components of the turbine wheel and the integral rim.

Yet another object of the present invention is to provide an improved, unitary ceramic gas turbine wheel for use in gas turbine engines operating with turbine inlet temperatures in excess of 2000° F.; the wheel having a hub with a radially extending disc therefrom connected by an integral neck to an integrally formed, continuously circumferentially extending rim that defines a gas flow path of reduced axial length across the surface of the rim and having a plurality of integrally formed, radially extending airfoil configured blades extending therefrom at circumferentially spaced points therearound; each blade having a leading edge located upstream of the rim which is faired into the outer rim surface by a plurality of inertia reducing scallops in the upstream face of the disc and with the scallops being configured to reduce stress concentrations in the leading edge of each blade resulting from differential axial thermally produced strain between the blade roots and the integrally formed rim connected thereto and further to reduce the polar moment of inertia of the turbine wheel, thereby to improve engine acceleration characteristics.

Further objects and advantages of the present invention will be apparent from the following description, reference being had to the accompanying drawings wherein a preferred embodiment of the present invention is clearly shown.

Figure 1:
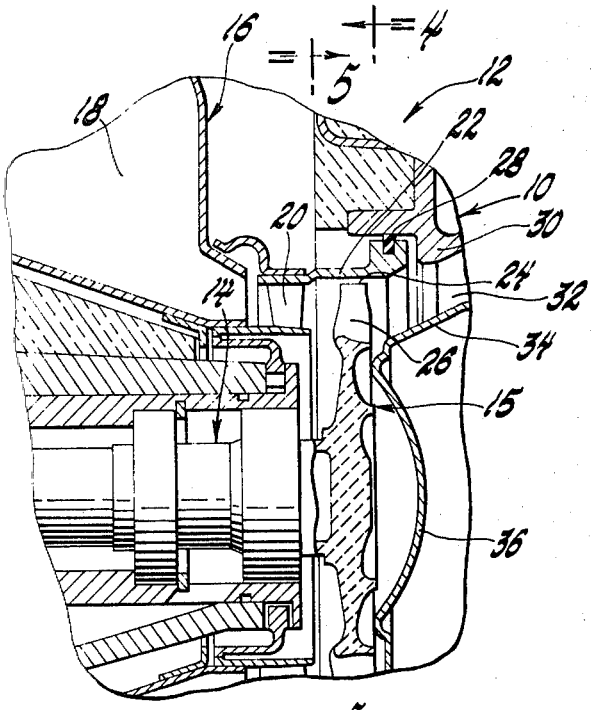
FIG. 1 is a fragmentary, longitudinal sectional view of the hot section of a gas turbine engine.

Referring now to the drawings, in FIG. 1 a hot gas section 10 of a gas turbine engine 12 is illustrated. It includes a shaft assembly 14 having a unitary, high temperature ceramic gas turbine wheel 15 connected to its outboard end configured in accordance with the present invention. The hot gas section 10 includes an outlet transition 16 on a combustor 18. Combustor 18 has air and fuel supplied thereto for producing combustion products that are directed through an annular row of nozzle vanes 20 upstream of an annular shroud 22 that surrounds the radially outermost tips 24 of integrally formed blades 26 on the ceramic turbine wheel 15 of the present invention. The shroud 22 is sealed by an annular seal element 28 with respect to an engine bulkhead 30 that forms part of a gas flow passage 32 having the inner wall thereof defined by a segment 34 of a diaphragm member 36 located downstream of the turbine wheel 15.

In accordance with the present invention, the turbine wheel 15 is of unitary construction, preferably formed of ceramic materials such as silicon carbide having a design tensile strength in the order of 30 ksi. Such ceramic wheels are capable of operating in high temperature environments and at turbine inlet temperatures in excess of 2000° F.

Figure 2:
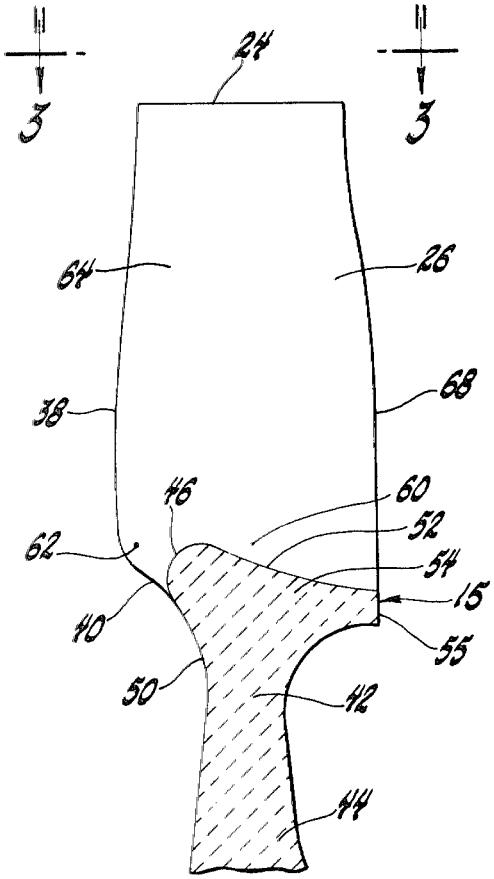
FIG. 2 is an enlarged, fragmentary view, partially in elevation and partially in cross section of a turbine wheel used in the gas turbine engine section of FIG. 1.
Figure 3:
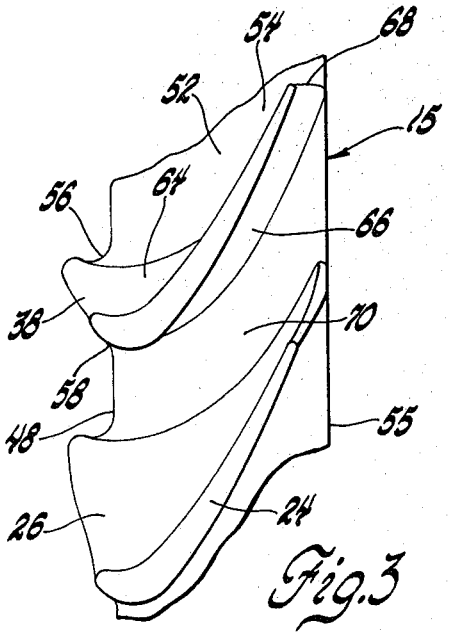
FIG. 3 is a fragmentary, top elevational view of a part of the turbine wheel of the present invention looking in the direction of the arrows 3—3 in FIG. 2.
Figure 5:
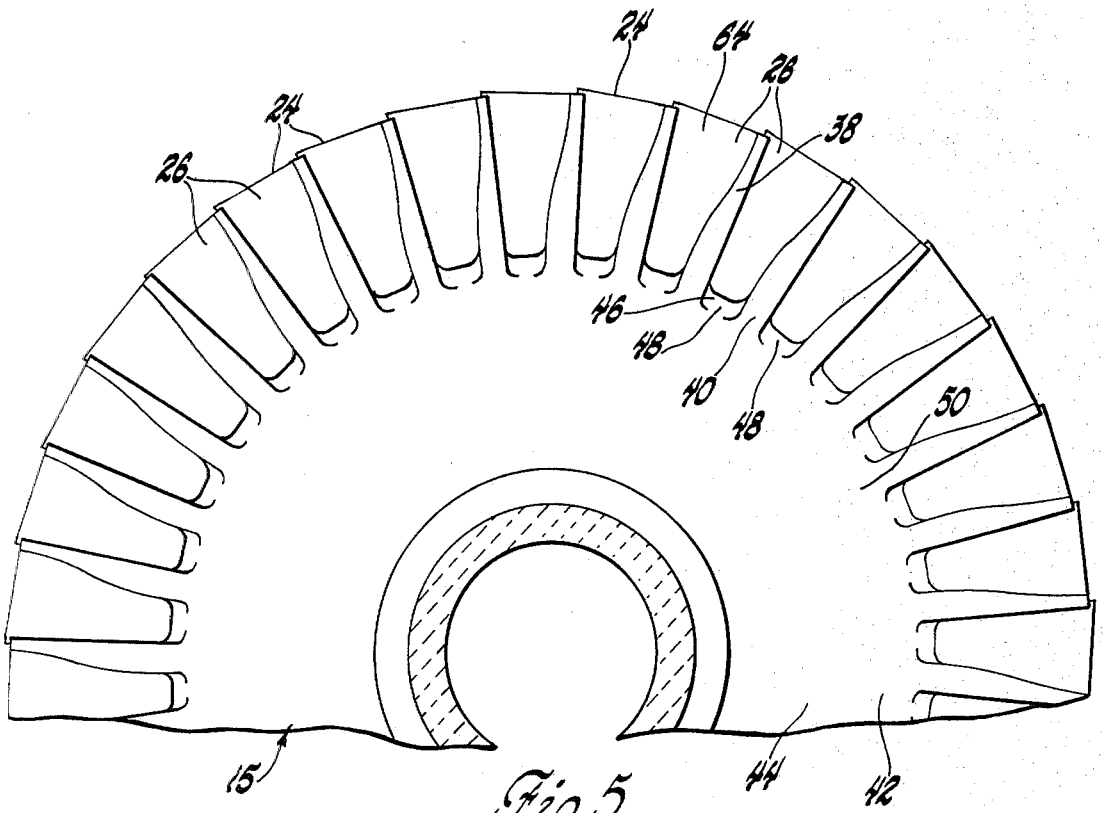
FIG. 5 is an enlarged vertical sectional view taken along the line 5—5 of FIG. 1 looking in the direction of the arrows.

In order to operate at such temperatures and to avoid excessive stress build-up in leading edges of airfoil configured blades, means must be provided to control differential axial thermal growth between integrally formed blades and a rim portion of the turbine wheel 15. More particularly, the individual blades 26 include a leading edge 38 that is merged by a faired root region 40 thereon to a neck 42 of a radial disc 44 of the turbine wheel 15. A plurality of circumferentially spaced, conoidally configured upstream transitions 46 on disc 44 define a plurality of scallops 48 located at circumferentially spaced points around the outer periphery of the upstream face 50 of the disc as best shown in FIG. 5. The scallops 48 reduce the polar moment of inertia of the turbine wheel 15 thereby improving engine performance by increasing its acceleration characteristics by use of the turbine wheel 15. The transitions 46 form the fore face of an upper surface 52 of a continuously formed circumferential rim 54 on wheel 15. Also, the leading edges 38 are faired into the upper surface 52 of rim 54 on the turbine wheel 15 by fairing segments 56, 58 formed on either side of each of the leading edges 38 as best seen in FIG. 3. The upper surface 52 of the rim 54 merges with an aft face 55. Thus, rim 54 is of reduced axial length as compared to the axial length of the individually integrally formed blades 26 at a root region 60 thereon and as a result there is a reduced axial thermal differential strain between the blade and the rim 54 at the leading edges 38 so that airfoil stresses in the blades 26 at the leading edge thereof will be reduced and maintained substantially below the strength characteristics of typical ceramic materials. More specifically, in the illustrated arrangement, it has been observed that turbines operating at turbine inlet temperatures of 2000° F.

will have a localized radial stress concentration at a point illustrated at 62 in FIG. 2 within a nominal radial stress range on the blades and well within the strength limits of typical ceramics such as SiC.

Figure 4:
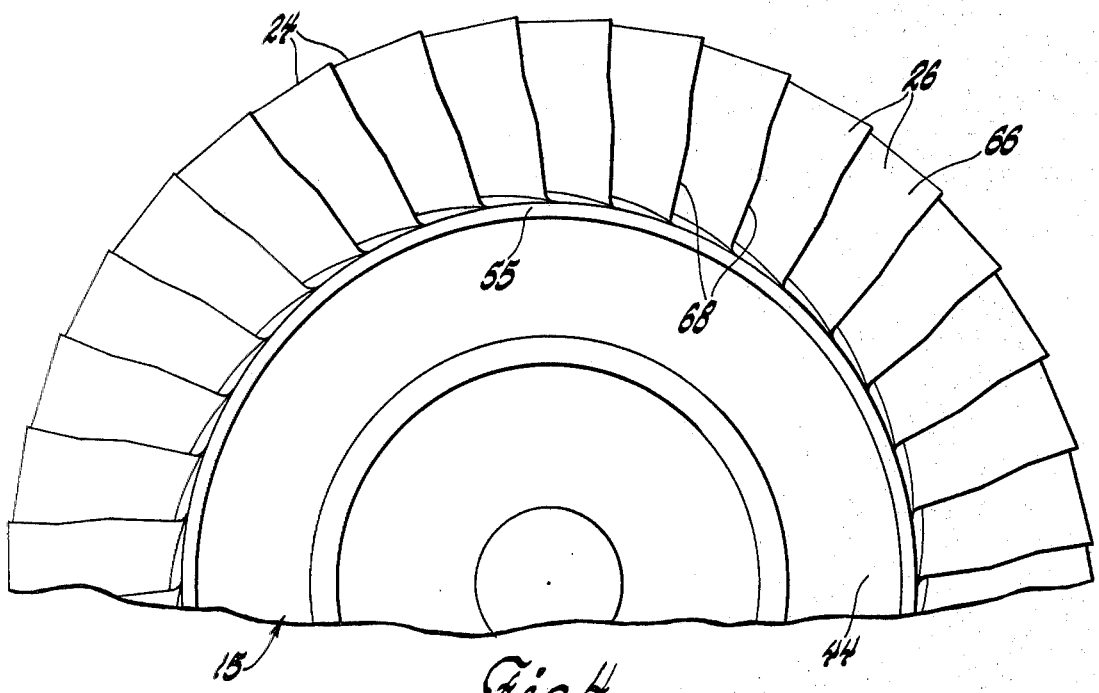
FIG. 4 is an enlarged, fragmentary end elevational view of the turbine wheel of the present invention looking in the direction of the arrows 4—4 of FIG. 1.

Airflow across the airfoil contoured blades 26, including concave and convex surfaces 64, 66 that connect the leading edge 38 to a trailing edge 68, is maintained by the upstream configurations on turbine wheel 15 so that aerodynamically efficient gas flow paths 70 are defined axially through the turbine wheel 15 between each pair of blades 26 thereon. The paths 70 diverge in a radial direction to a point on the blades 26 at the trailing edge thereof 68 to produce a flow path of greater depth at the outlet of the wheel as shown in FIG. 4.

While the embodiments of the present invention, as herein disclosed, constitute a preferred form, it is to be understood that other forms might be adopted.

The embodiments of the invention in which an exclusive property or privilege is claimed are defined as follows:

1. A unitary ceramic gas turbine wheel comprising: a hub with a radially extending disc thereon, a wheel rim having a plurality of spaced, fore face segments and an aft face, a neck integrally joining said wheel rim to said disc, a plurality of blades with roots integrally joined to said rim at the outer surface thereof, each of said blades having a leading edge and a trailing edge, concave convex airfoil surfaces joining said leading and trailing edges, said wheel rim having an axial length less than that of said blade roots, each of said blades having its leading edge located upstream of said fore faces and being joined to said neck and fore faces by a faired root region, said faired root regions and said fore faces on said rim forming scallops in said wheel between each of said leading edges to reduce differential thermal expansion strain at the leading edges to prevent excessive thermal stress concentrations in said blades and wherein said scallops further are configured to reduce the polar movement of inertia of said turbine wheel to improve the acceleration characteristics thereof.

* * * * *